US011480163B2

(12) United States Patent
Al-Dhafiri

(10) Patent No.: US 11,480,163 B2
(45) Date of Patent: Oct. 25, 2022

(54) PUMPING SYSTEM WITH CONTROL FEATURES FOR CONTROLLING STROKE DURATION AND INJECTION VOLUME

(71) Applicant: Saudi Arabian Oil Company, Dhahran (SA)

(72) Inventor: Amer A. Al-Dhafiri, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 535 days.

(21) Appl. No.: 16/113,047

(22) Filed: Aug. 27, 2018

(65) Prior Publication Data

US 2020/0063725 A1 Feb. 27, 2020

(51) Int. Cl.

| | |
|---|---|
| ***F04B 9/02*** | (2006.01) |
| ***F04B 13/00*** | (2006.01) |
| ***F04B 23/06*** | (2006.01) |
| ***F04B 49/06*** | (2006.01) |
| ***F04B 49/20*** | (2006.01) |
| ***F04B 15/04*** | (2006.01) |
| *F04B 17/03* | (2006.01) |

(52) U.S. Cl.

CPC ..... *F04B 9/025* (2013.01); *F04B 13/00* (2013.01); *F04B 15/04* (2013.01); *F04B 23/06* (2013.01); *F04B 49/065* (2013.01); *F04B 49/20* (2013.01); *F04B 9/02* (2013.01); *F04B 17/03* (2013.01); *F04B 2201/0201* (2013.01); *F04B 2201/0202* (2013.01); *F04B 2201/0209* (2013.01)

(58) Field of Classification Search

CPC ..... F04B 9/025; F04B 2201/0209

See application file for complete search history.

(56) References Cited

U.S. PATENT DOCUMENTS

| | | | | |
|---|---|---|---|---|
| 5,282,490 | A | 2/1994 | Higgs | |
| 5,388,965 | A * | 2/1995 | Fehn | F04B 13/00 417/63 |
| 6,398,514 | B1 * | 6/2002 | Smith | F04B 9/025 222/309 |
| 6,575,331 | B1 * | 6/2003 | Peeler | F04B 13/00 222/1 |
| 8,215,922 | B2 | 7/2012 | Berger et al. | |

(Continued)

FOREIGN PATENT DOCUMENTS

| | | |
|---|---|---|
| CN | 201827040 U | 5/2011 |
| WO | WO-2013/156087 A1 | 10/2013 |

OTHER PUBLICATIONS

International Search Report for PCT/IB2018/057820, 6 pages (dated Jan. 3, 2019).

(Continued)

*Primary Examiner* — Essama Omgba
*Assistant Examiner* — Timothy P Solak
(74) *Attorney, Agent, or Firm* — Osha Bergman Watanabe & Burton LLP

(57) ABSTRACT

A pumping system includes a head having an opening and an injection port. The head is for holding content to be forced through the injection port. A bladder is within the head. The bladder is between the content and the opening. A plunger is configured to move through the opening of the head and to apply force within the bladder. The plunger may be movable in a discharge stroke to force the bladder against the content and thereby force the content through the injection port.

19 Claims, 7 Drawing Sheets

(56) References Cited

U.S. PATENT DOCUMENTS

| | | | | |
|---|---|---|---|---|
| 2004/0234377 | A1 | 11/2004 | Bolt | |
| 2005/0069425 | A1 | 3/2005 | Gray et al. | |
| 2008/0226468 | A1* | 9/2008 | Jackson | B65B 3/12 417/53 |
| 2009/0016903 | A1 | 1/2009 | Savard et al. | |
| 2009/0068032 | A1* | 3/2009 | Furey | F04B 23/06 417/395 |
| 2010/0021326 | A1* | 1/2010 | Oguma | F04B 43/0054 417/472 |
| 2013/0104631 | A1* | 5/2013 | Tokuo | F04B 13/00 73/61.56 |
| 2013/0202454 | A1 | 8/2013 | Gerz et al. | |
| 2014/0161627 | A1* | 6/2014 | Sivaramakrishnan | F04B 1/128 417/2 |
| 2016/0153441 | A1* | 6/2016 | Fehr | F04B 49/10 73/168 |
| 2017/0021951 | A1* | 1/2017 | Teague | B65B 3/003 |

OTHER PUBLICATIONS

Written Opinion for PCT/IB2018/057820, 8 pages (dated Jan. 3, 2019).
International Preliminary Examining Authority Written Opinion for PCT/IB2018/057820, 6 pages (dated Aug. 6, 2020).
International Preliminary Report on Patentability for PCT/IB2018/057820, 20 pages (dated Nov. 13, 2020).

* cited by examiner

PUMPING SYSTEM WITH CONTROL FEATURES FOR CONTROLLING STROKE DURATION AND INJECTION VOLUME

TECHNICAL FIELD

This specification describes examples of a pumping system configured to control functions, such as stroke duration and injection volume.

BACKGROUND

Dosing pumps may be used in applications in which a small amount of liquid is injected into a target. Examples of dosing pumps include metering pumps and positive displacement controlled volume pumps. Examples of targets include a process pipe or other equipment. A dosing pump may have a reciprocating pump design. In such a design, a plunger moves in strokes to inject a small amount of liquid to the target in each stroke. For example, the amount of liquid injected may be on the order of milliliters (mL) or sub-milliliters per stroke. The presence of gas—for example, air—bubbles inside the pump can have an adverse effect on the pump's ability to operate. For example, the bubble may compress with each stroke, which may impede the output of the pump. As a result, the pump's output may be reduced or may stop altogether. In an example, a pump may be configured to force one 1 mL per stroke at a rate of 300 strokes per minute. If the pump has a 2 mL gas bubble in its internal cavity, each stroke may compress the bubble. But, because each stroke is sufficient to output only 1 mL (that is, less than 2 mL), the bubble will prevent the pump from applying enough pressure to the liquid to achieve discharge from the pump.

SUMMARY

An example pumping system includes a head having an opening and an injection port. The head is for holding content to be forced through the injection port. A bladder is disposed within the head. The bladder may include rubber, for example. The bladder is between the content and the opening. A plunger is configured to move through the opening of the head and to apply force within the bladder. The plunger may be movable in a discharge stroke to force the bladder against the content and thereby force the content through the injection port. The example pumping system may include one or more of the following features, either alone or in combination.

The example pumping system may include hydraulic oil between the bladder and the plunger. The plunger may be configured to apply force to the hydraulic oil during the discharge stroke. The hydraulic oil transfers the force from the plunger to the bladder to force the content through the injection port.

The content may include one or more of a corrosion inhibiter, a substance to control water acidity, or an anti-foaming chemical.

The example pumping system may include a driver to control movement of the plunger. The driver may be for controlling the movement of the plunger so that the discharge stroke of the plunger proceeds for a first duration, a suction stroke of the plunger proceeds for a second duration, and the first duration exceeds the second duration. The first duration may be twenty or more minutes and the second duration may be one or more seconds. The driver may include a mechanism that is configured to operate over a range of speeds to control the duration of the discharge stroke. The driver may include a variable-speed motor or a variable-speed actuator.

The head, the bladder, and the plunger may comprise components of a first pump, in which the plunger is a first plunger. The pumping system may comprises one or more additional pumps. The one or more additional pumps may comprise a second pump. The second pump may comprise a second head having a second opening and a second injection port. The second head may be configured for holding second content to be forced through the second injection port. A second plunger may be configured to move through the second opening of the second head to force the second content through the second injection port.

The second pump may also include a second bladder within the second head. The second bladder is between the second content and the second opening. The second plunger may be configured to move through the second opening of the second head and to apply force within the second bladder. The second plunger may be movable in a discharge stroke to force the second bladder against the second content and thereby force the second content through the second injection port.

The example pumping system may include a shaft connected to both the first plunger and to the second plunger, and driver connected to the shaft. The driver may be configured to control movement of the first plunger and the second plunger by controlling movement of the shaft. The shaft may be connected to all of the additional pumps. The driver may be configured to control all of the additional pumps by controlling movement of the shaft. The driver may be configured to control at least a duration of the discharge stroke. One or more processing devices may be configured—for example, programmed—to control one or more operations of the driver, such as the duration of the discharge stroke, the duration of the suction stroke, or both.

An example pumping system includes multiple pumps. Each of the multiple pumps is configured to inject content into a different target. The multiple pumps include respective plungers that are controllable to move to control injection of the content. The example pumping system includes a driving mechanism configured to provide common control over the plungers to control injection of the content. The driving mechanism is configured to control at least one of the plungers so that a discharge stroke of the at least one plunger proceeds for a first duration, a suction stroke of the at least one plunger proceeds for a second duration, and the first duration exceeds the second duration. The example pumping system may include one or more of the following features, either alone or in combination.

The example pumping system may include a coupling—for example, a physical connection—to connect the driving mechanism to the plungers. The coupling may be configured to impart motion of the driving mechanism to the plungers. Each of the pumps may be configured to inject a different type of content into a target. At least one of the pumps may comprise an elastic bladder between the plunger and the content. The driving mechanism may comprise a variable-speed actuator or a variable-speed motor. The first duration may be on an order of one or more hours and the second duration may be on an order of one or more minutes.

Any two or more of the features described in this specification, including in this summary section, can be combined to form implementations not specifically described in this specification.

At least part of the systems and methods described in this specification may be controlled by executing, on one or more processing devices, instructions that are stored on one or more non-transitory machine-readable storage media. Examples of non-transitory machine-readable storage media include, but are not limited to, read-only memory, an optical disk drive, memory disk drive, random access memory, and the like. At least part of the systems and methods described in this specification may be controlled using a computing system comprised of one or more processing devices and memory storing instructions that are executable by the one or more processing devices to perform various control operations.

The details of one or more implementations are set forth in the accompanying drawings and the description below. Other features and advantages will be apparent from the description and drawings, and from the claims.

DESCRIPTION OF THE DRAWINGS

Like reference numerals in different figures indicate like elements.

DETAILED DESCRIPTION

Figure 1:
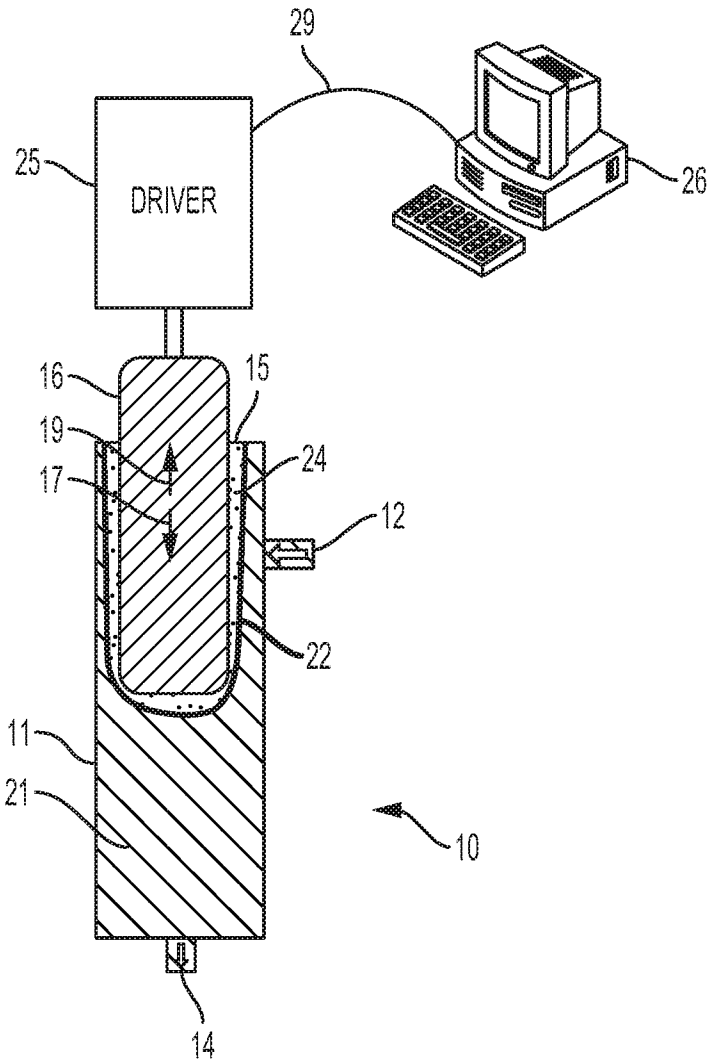
FIG. 1 is a block diagram of an example pump having a bladder.

Described in this specification are implementations of a pumping system. In an example, the pumping system includes a head configured to hold content, such as liquid, to be forced through an injection port to a target. A bladder, which may be made of elastic such as rubber, is disposed within the head and is adjacent to the content. A plunger is configured to move through an opening in the head to apply force within the bladder. For example, the plunger is movable in a discharge stroke to force the bladder against the content and thereby force the content through the injection port and into the target. The bladder may be filled with hydraulic oil. The force of the plunger may cause the hydraulic oil to push the bladder against the content and thereby force the content through the injection port and into the target. That is, the hydraulic oil transfers the force from the plunger to the bladder. The bladder expands against the content to force the content through the injection port and into the target.

The pumping system includes a driver to control movement of the plunger. The driver may control the plunger so that a duration of the discharge stroke—for example, the stroke advancing into the head—exceeds a duration of the suction stroke—for example, the stroke retracting within the head. The difference in durations of the discharge stroke and the suction stroke may be orders of magnitude. In an example, the discharge stroke may have a duration that is twenty or more minutes and the suction stroke may have a duration that is one or more seconds or one or more minutes in duration. In an example, the discharge stroke may have a duration that is on the order of one or more hours and the suction stroke may have a duration that is on the order of one or more seconds or one or more minutes.

By using a bladder and increasing the duration of the discharge stroke, it may be possible to reduce the effects of gas bubbles or other anomalies within the content. For example, longer-duration injection strokes may push gas bubbles or other content anomalies through the injection port, thus limiting their effects on pump operation. For example, a pump may be configured and controlled to discharge 300 mL of fluid at a rate of one stroke-per-minute A gas bubble of, for example, 2 mL, may be forced out of the pump by this longer-duration stroke, reducing the impact that the gas bubble will have on pumping. In this example, 298 mL of fluid will be output by the pump via the single discharge stroke, along with the 2 mL gas bubble.

Thus, use of a bladder may thus improve the plunger's ability to discharge content over longer durations and may improve venting in pump cavities.

The pumping system may include a single pump or multiple pumps. In the case of multiple pumps, there may be a single drive mechanism that functions as a common controller for the multiple pumps. For example, a driver may be coupled to the plunger of each of the pumps, and control the plungers concurrently. In an example, the driver may be coupled to each of the plungers via a shaft or other type of rigid coupling. As the driver moves the shaft, the plungers also each move along with the shaft. In some cases, this configuration enables different injection ports to different targets to be serviced concurrently, including those having different resistances to pumping.

FIG. 1 shows components included in an example pump 10. Example pump 10 includes a head 11. Head 11 may be made of material, such as metal or plastic. In this example, head 11 has a cylindrical shape; however, other shapes may be used. Head 11 includes an input port 12 to receive content to be pumped. Head 11 also includes an injection port 14. Injection port 14 constitutes an output, or exit, from the pump to a target, such as a process pipe or other equipment. Head 11 includes an opening 15. Opening 15 is configured—for example, sized and shaped—to receive a plunger 16. As described in this specification, the plunger advances and retracts within head 11 to force content out of the injection port and into a target. The content is typically liquid. Examples of content include a corrosion inhibiter, a substance to control water acidity, or an antifoaming chemical. Other types of content may be used.

Plunger 16 has a cylindrical shape in this example; however, plunger 16 is not limited to a cylindrical shape. Plunger 16 may be made of the same material as head 11 or of a different material. For example, plunger 16 may be made of metal or plastic. Plunger 16 is configured to move within head 11. This movement, as described in this specification, forces content in head 11 through injection port 14 and into the target. In an example, the plunger is controlled so that its discharge stroke—for example, the stroke of the plunger in the direction of arrow 17—exceeds a duration of the suction stroke—for example, the stroke of the plunger in the direction of arrow 19. During the discharge stroke, plunger 16 advances into head 11 to pressurize the content 21 within the head and thereby force content 21 out of injection port 14. During the suction stroke, plunger retracts within head 11, readying the plunger for initiation of a subsequent discharge stroke. In some implementations, injection port 14 includes a mechanism, such as a check valve, that prevents content from being suctioned back into the plunger from the target during the suction stroke.

In this example, pump 10 includes a bladder 22. Bladder 22 is elastic. Bladder 22 may be made of rubber, but also may be made of, or include, other elastic materials. Bladder 22 is fixed within head 11 to create separate chambers. One chamber houses plunger 16. The other chamber houses content 21. Bladder 22 may provide a liquid-tight or air-tight connection between the two chambers, thereby isolating the content from the plunger. Bladder 22 may be attached to the inner surface of head 11 to implement this connection. Bladder 22 is configured—for example, structured and arranged—to expand in response to pressure applied from the plunger. For example, as plunger 16 advances into head 11 during a discharge stroke, bladder 22 also advances into head 11 along with the plunger, for example, bladder 22 stretches. This action forces content 21 out through injection port 14 and into the target.

In some implementations, the chamber that contains plunger 16 also contains hydraulic oil 24 or other substance having a viscosity that is similar to the viscosity of hydraulic oil. In this example, the hydraulic oil and the bladder transmit the force generated by the plunger movement to the liquid being discharged. For example, in some implementations, the hydraulic oil may act as a barrier or buffer between the plunger and the bladder such that there is no direct physical contact between the plunger and the bladder at any time during operation of the pump. For example, the entirety of the plunger may be lubricated with the hydraulic oil. The plunger applies force to the hydraulic oil. The hydraulic oil transfers that force to the bladder. The bladder, in response, expands, forcing the liquid out of the pump.

In this example, the hydraulic oil lubricates the plunger and the bladder. This lubrication may improve an interaction between the plunger and the bladder. For example, the lubrication reduces friction between the plunger and opening 15, which facilitates expansion of the bladder in response to force applied by the plunger. Furthermore, the lubrication may reduce the chances that the bladder will dry, crack, or otherwise be damaged by environmental factors.

In some implementations, there is no hydraulic oil or other substance between the plunger and the bladder. For example, the plunger may apply force directly to the bladder absent an intermediary substance, such as hydraulic oil.

Pump 10 includes a driving mechanism. The driving mechanism may include a driver 25, such as an actuator or a motor, that drives motion of the plunger. The driver may be a variable-speed device, such as a variable-speed motor or a variable-speed actuator. A variable-speed device may be configured to operate over a range of speeds. A variable-speed device may be configured to change speeds during the course of operation. A variable speed device may be configured to select of a speed of operation and to maintain that speed over the course of operation.

The variability of the driver's speed enables the pump to be operated at different—for example, variable—stroke rates. The variations may occur over different pump cycles or within the same pump cycle. In this example, a pump cycle includes the sequence of discharge strokes and suctions strokes used to pump all content from a head into a target. The driving mechanism may also include a computing system 26 that is configured—for example, programmed—to control operation of the driver. In this example, the connection 29 between the driver and the computer system is wired; however, the connection may be wireless. Examples of computing systems that may be used are described in this specification. The computing system may define, for example, the duration of each discharge stroke, each suction stroke, or both within a pump cycle. These durations may be set by a user and may be based on various factors. For example, the durations may be based on the type of the content, the rate at which the content is needed by the target, the amount of content to be pumped, or a combination of two or more these or other factors.

In operation, driver 25 may control the plunger so that a duration of a discharge stroke exceeds a duration of a suction stroke. In operation, driver 25 may control the plunger so that a duration of every discharge stroke exceeds a duration of every suction stroke. In some implementations, the durations of the discharge stroke and the suction stroke may be programmed into the computing system and used to control operation of the driver which, in turn, controls operation of the pump. In some implementations, the durations of the discharge stroke and the suction stroke may be set in the driver itself, and used by the driver to control operation of the pump. In an example, the discharge stroke may have a duration that is on the order of one or more hours and the suction stroke may have a duration that is on the order of one or more minutes. This operation may reduce the amount of time that the pump is not operating.

In an example operation, the pump is configured to pump three (3) liters (L) using one discharge stroke having a duration of about an hour (instead of using thousands of strokes having shorter durations to pump smaller volumes per stroke). In this example, the suction stroke has a duration of about one (1) to three (3) minutes. This is an example only. The pump systems described in this specification may be used to pump different volumes and the discharge stroke and suction strokes may have different durations. In other examples, the discharge stroke may have a duration that is twenty (20) or more minutes and the suction stroke may have a duration that is one (1) or more seconds or one (1) or more minutes in duration.

Figure 2:
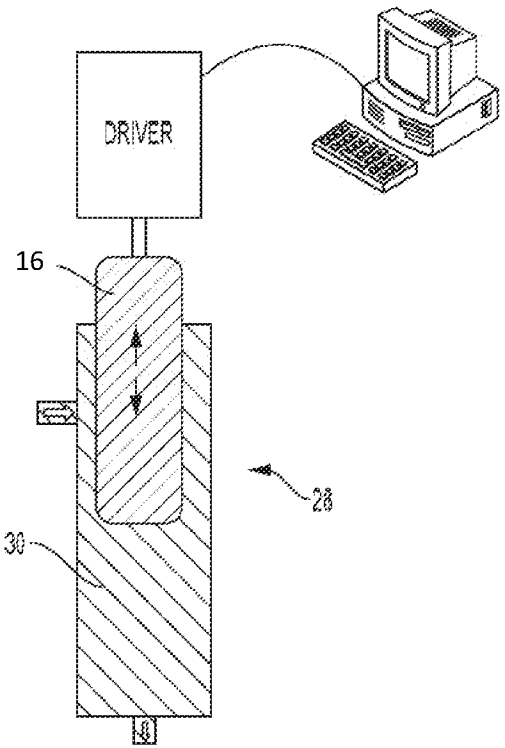
FIG. 2 is a block diagram of an example pump not having a bladder.

In some implementations, an example pump may include the features and functionality of pump 10, but not the bladder. An example pump 28 of this type is shown in FIG. 2. In pump 28, there is no bladder between the plunger 29 and the content 30 to be pumped. Instead, plunger 29 and content 30 are in direct contact. The structure and function of pump 28 is otherwise the same as the structure and function of pump 10, including the use of discharge strokes that are longer in duration than suction strokes. Configurations that do not include a bladder, such as pump 28, may be more amenable to use with content, such as liquids, that have a lubricity that is the same as, or similar to, the lubricity of hydraulic oil. Configurations that do include a bladder, such as pump 10, may be more amenable to use with content, such as liquids, that have a lubricity that is less than the lubricity of hydraulic oil. Configurations that do include a bladder, such as pump 10, may also be more amenable to use with liquids that are corrosive. However, neither of the pump configurations of FIG. 1 or 2 is limited to use with a specific type of content.

Figure 3:
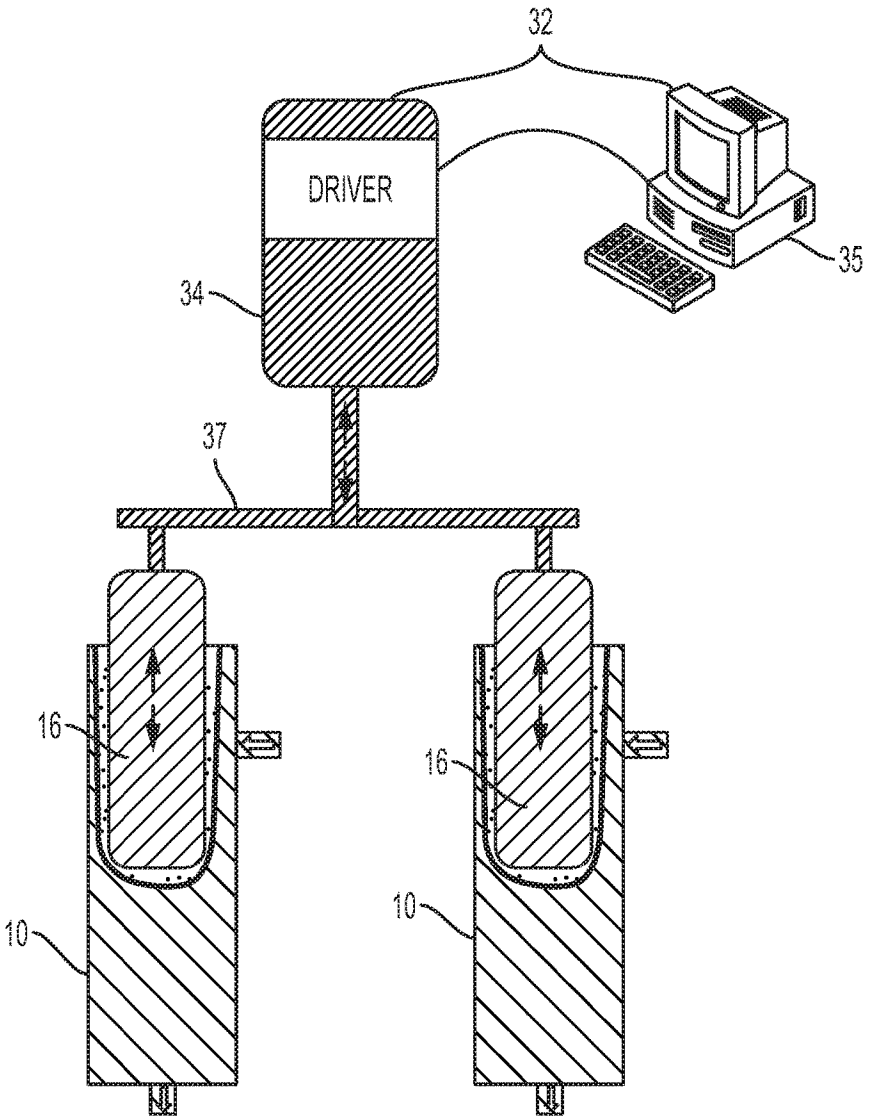
FIG. 3 is a block diagram of an example pumping system comprised of pumps having a bladder.
Figure 4:
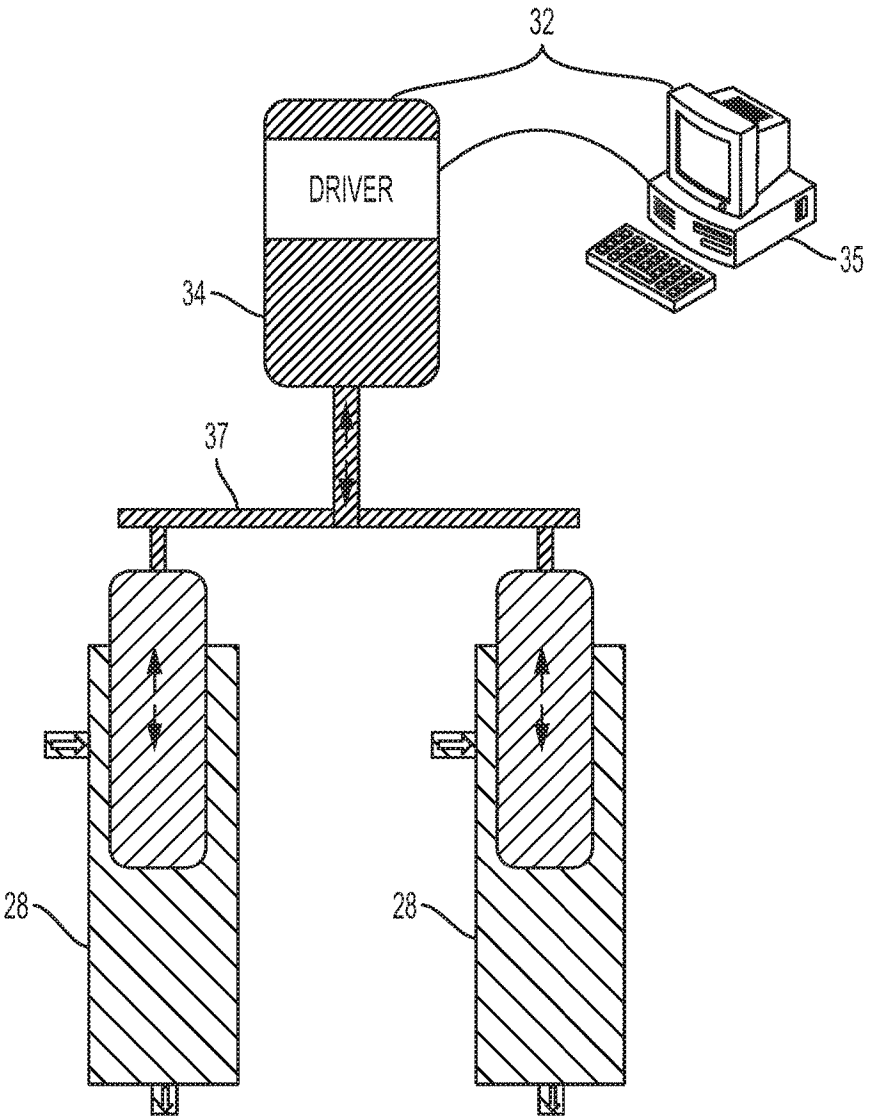
FIG. 4 is a block diagram of an example pumping system comprised of pumps not having a bladder.
Figure 5:
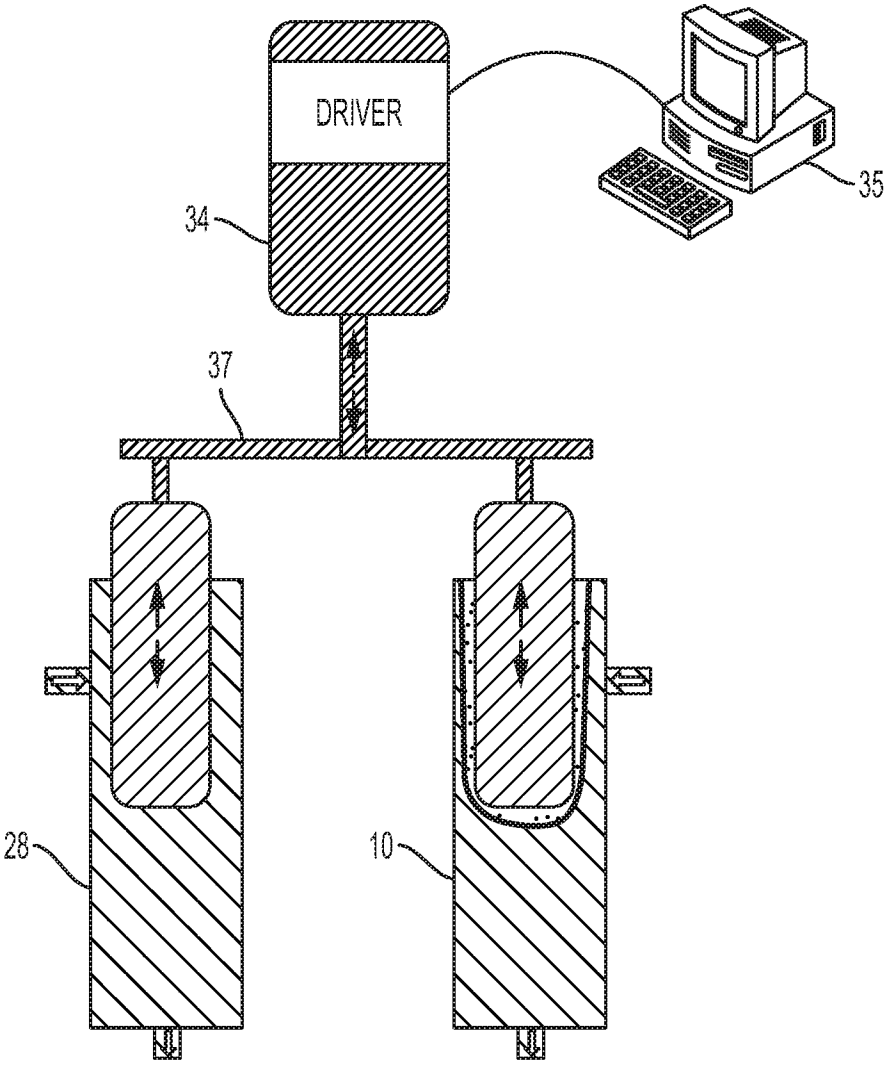
FIG. 5 is a block diagram of an example pumping system comprised of a pump having a bladder and a pump not having a bladder.

In some implementations, a pumping system may include two or more pumps that are coupled together and controlled by a common driving mechanism. In the example of FIG. 3, two pumps having the configuration of pump 10 are coupled together, and the two are controlled by a common driving mechanism 32. In the example of FIG. 4, two pumps having the configuration of pump 28 are coupled together, and the two are controlled by common driving mechanism 32. In the example of FIG. 5, a first pump having the configuration of pump 28 is coupled to a second pump having the configuration of pump 10, and the two are controlled by common driving mechanism 32. Although only two pumps are shown in each of FIGS. 3, 4, and 5, a common driving mechanism may operate more than two pumps in concert. For example, the number of pumps operated in concert may be three, four, five, six, seven, or more. Moreover, there are no restrictions on the types of pumps that can be coupled.

As was the case previously, driving mechanism 32 may include a driver 34, such as an actuator or a motor, that drives motion of the plunger. The driver may be a variable-speed device, such as a variable-speed motor or variable-speed actuator. Driving mechanism 32 may also include a computing system 35 to control the driver, or the driver may operate independently of a computing system.

In some implementations, the coupling between two or more pumps and the driver may be, or include, a shaft connected to each pump's plunger and to the driver. The shaft may be rigid and be made of materials, such as metal, plastic, wood, or composite. Taking FIG. 3 as an example, shaft 37 is physically connected to each of plungers 16 and to driver 34. The connection may be direct or through one or more intermediary components. The shaft may include one component or multiple components. The connection between the shaft and each plunger may be rigid or there may be a movable or rotary joint connecting each plunger to the shaft. The driver is configured to control movement of the shaft and, by virtue of the coupling between the shaft and the plungers, to control movement of each plunger.

Figure 6:
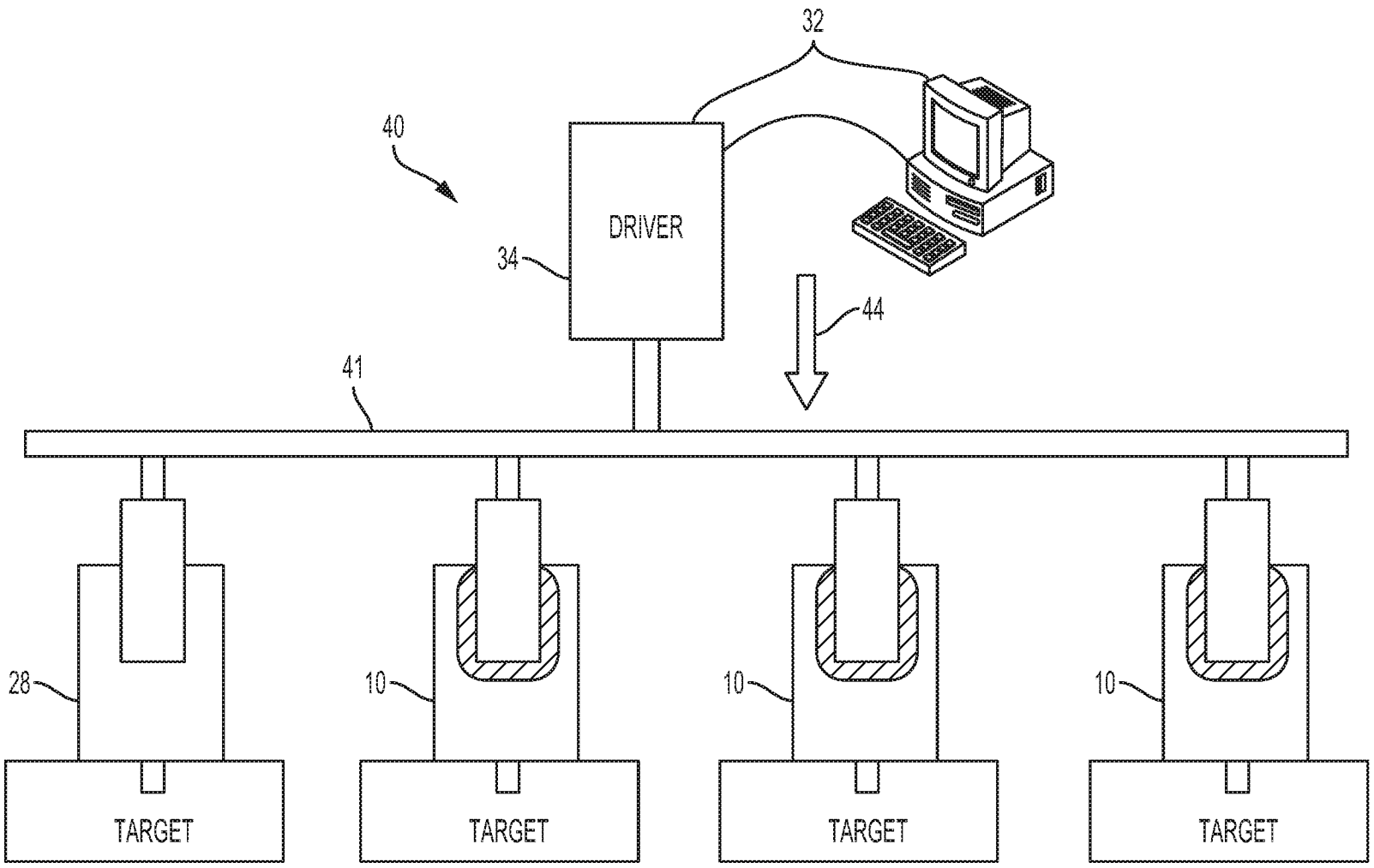
FIGS. 6 and 7 are block diagrams of the same example pumping system at different stages of operation.
Figure 7:
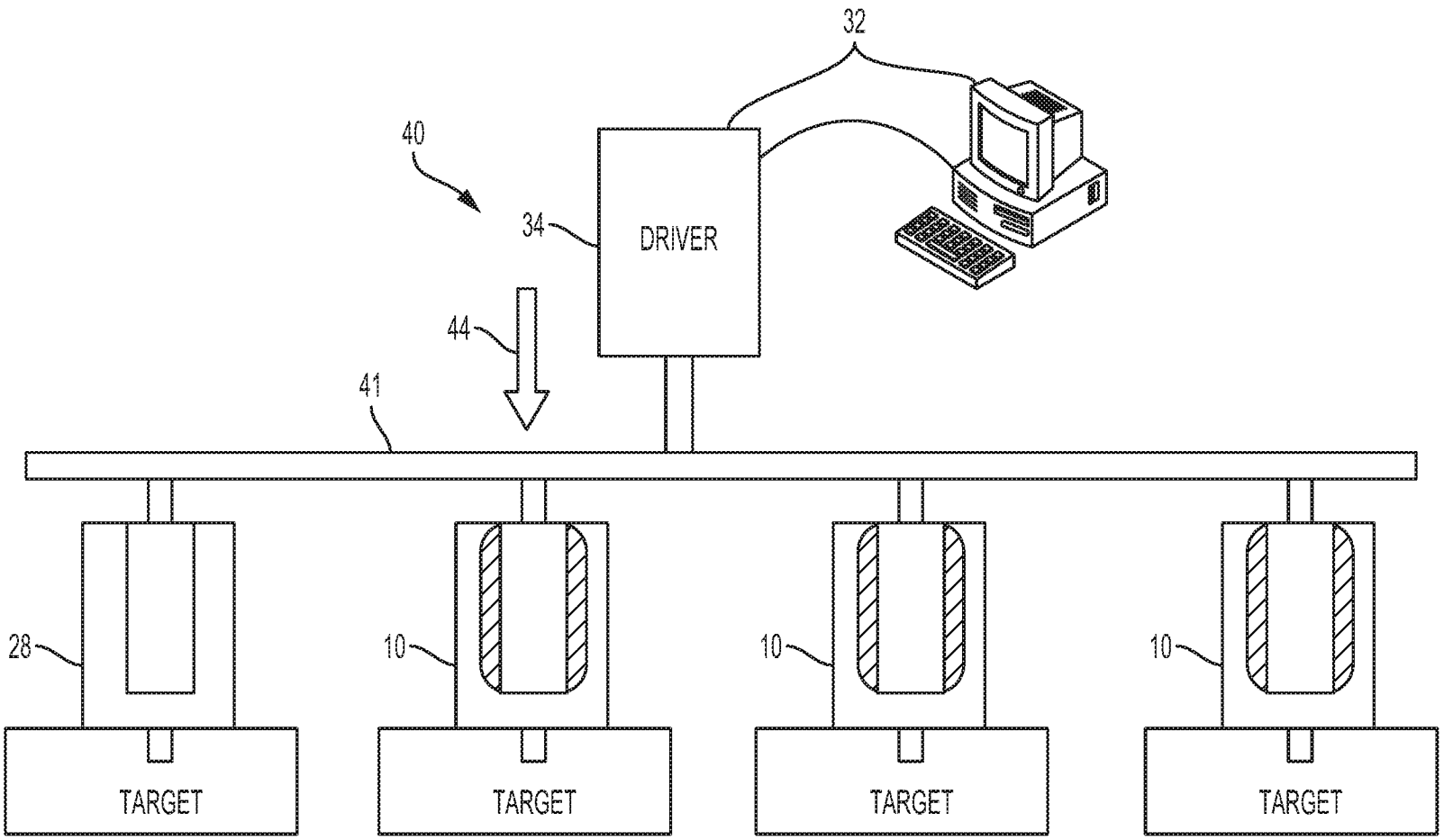

Referring FIGS. 6 and 7, example system 40 includes three pumps having the configuration of pump 10 connected in common and also connected in common with one pump having the configuration of pump 28. Operation of these four pumps are controlled by common driving mechanism 32 of the type described previously. A rigid coupling 41 connects driver 34 to the pumps. During operation, driver 34 forces coupling 41 to move in the direction of arrow 44. As shown in FIG. 7, the resulting movement of coupling 41 causes the plunger of each pump to move in concert in the direction of arrow 44. This movement—which will occur in pumps having or not having the bladder—pressurizes the content in each of the pump heads. This pressure forces the content out of the pump injection ports and into respective targets of the pumps. The targets may be different devices or systems, as shown. The content may be different for each pump-target combination included in the system.

The example pumps described in this specification may be dosing or metering pumps. The example pumps may be pumps having uses other than dosing or metering.

The example pumping systems described in this specification may be implemented in conjunction with—for example, the driving mechanism may include—one or more computing systems. In an example, a computing system includes various controllers, processing devices, or both to monitor and to control operation of one or more pumps. A central computer may coordinate operation among the various controllers or processing devices. The central computer, controllers, and processing devices may execute various software routines to effect control and coordination of the various automated elements.

The pumping systems described in this specification can be monitored, controlled, or both using one or more computer program products, such as one or more computer program tangibly embodied in one or more information carriers, such as one or more non-transitory machine-readable media, for execution by, or to control the operation of, one or more data processing apparatus, such as a programmable processor, a computer, multiple computers, or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with monitoring, control, or both can be performed by one or more programmable processors executing one or more computer. Actions associated with monitoring, control, or both can be implemented using special purpose logic circuitry, such as an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer (including a server) include one or more processors for executing instructions and one or more storage area devices for storing instructions and data. Generally, a computer will also include, or be operatively coupled to receive data from, or to transfer data to, or both, one or more machine-readable storage media, such as mass storage devices for storing data, such as magnetic, magneto-optical disks, or optical disks. Machine-readable storage media suitable for embodying computer program instructions and data include all forms of non-volatile storage area, including by way of example, semiconductor storage area devices, such as EPROM, EEPROM, and flash storage area devices; magnetic disks, for example, internal hard disks or removable disks; magneto-optical disks; and CD-ROM and DVD-ROM disks.

Elements of different implementations described in this specification may be combined to form other implementations not specifically set forth above. Elements may be left out of the structures described in this specification without adversely affecting their operation. Furthermore, various separate elements may be combined into one or more individual elements to perform the functions described in this specification.

What is claimed is:

1. A pumping system comprising:

a head comprising an opening and an injection port, the head being configured for holding content to be forced through the injection port;

a bladder within the head, the bladder between the content and the opening; and a plunger configured to move through the opening of the head and to apply force within the bladder, the plunger being movable in a discharge stroke to force the bladder against the content and thereby force the content through the injection port; and a driver to control the movement of the plunger, the driver for controlling the movement of the plunger so that the discharge stroke of the plunger proceeds for a first duration, a suction stroke of the plunger proceeds for a second duration, and the first duration exceeds the second duration, where the first duration is at least one order of magnitude greater than the second duration.

2. The pumping system of claim 1, further comprising:

hydraulic oil between the bladder and the plunger, the plunger being configured to apply force to the hydraulic oil during the discharge stroke, the hydraulic oil transferring the force from the plunger to the bladder to force the content through the injection port.

3. The pumping system of claim 1, where the first duration is twenty or more minutes and the second duration is one or more seconds.

4. The pumping system of claim 1, the driver is configured to operate over a range of speeds to control a duration of the discharge stroke.

5. The pumping system of claim 4, where the driver comprises a variable-speed motor, and where the opening receives the plunger.

6. The pumping system of claim 4, where the driver comprises a variable-speed actuator, and where the content comprises an antifoaming chemical.

7. The pumping system of claim 1, where the bladder comprises rubber, and where the bladder creates separate chambers within the head, the separate chambers comprising:

a first chamber housing the plunger; and a second chamber housing the content.

8. The pumping system of claim 7, where the head, the bladder, and the plunger comprise components of a first pump, the plunger being a first plunger; and where the pumping system comprises one or more additional pumps, the one or more additional pumps comprising a second pump, the second pump comprising:

a second head comprising a second opening and a second injection port, the second head being configured for holding second content to be forced through the second injection port; and a second plunger configured to move through the second opening of the second head to force the second content through the second injection port.

9. The pumping system of claim 8, further comprising:

a shaft connected to the first plunger and to the second plunger;

a driver connected to the shaft, the driver being configured to control movement of the first plunger and the second plunger by controlling movement of the shaft, where the content comprises a substance to control water acidity.

10. The pumping system of claim 9, where the second pump further comprises:

a second bladder within the second head, the second bladder being between the second content and the second opening;

where the second plunger is configured to move through the second opening of the second head and to apply force within the second bladder, the second plunger being movable in a discharge stroke to force the second bladder against the second content and thereby force the second content through the second injection port, and where the bladder provides at least one of a liquid-tight connection and an air-tight connection between the first chamber and the second chamber, thereby isolating the content from the plunger.

11. The pumping system of claim 9, where the shaft is connected to all of the one or more additional pumps; and where the driver is configured to control all of the one or more additional pumps by controlling movement of the shaft.

12. The pumping system of claim 1, where the content comprises one of a corrosion inhibiter, a substance to control water acidity, and an antifoaming chemical.

13. The pumping system of claim 1, further comprising:

a driver to control the movement of the plunger, the driver to control at least a duration of the discharge stroke; and one or more processing devices to control operation of the driver, where the content comprises a corrosion inhibiter.

14. A pumping system comprising:

multiple pumps, each of the multiple pumps being configured to inject content into a different target, the multiple pumps comprising respective plungers that are controllable to move to control injection of the content; and a driving mechanism configured to provide common control over the plungers to control injection of the content;

where the driving mechanism is configured to control at least one of the plungers so that a discharge stroke of the at least one plunger proceeds for a first duration, a suction stroke of the at least one plunger proceeds for a second duration, and the first duration exceeds the second duration, and where the first duration is at least one order of magnitude greater than the second duration.

15. The pumping system of claim 14, further comprising:

a coupling to connect the driving mechanism to the plungers, the coupling to impart motion of the driving mechanism to the plungers.

16. The pumping system of claim 14, where each of the pumps is configured to inject a different type of content into a target.

17. The pumping system of claim 16, where at least one of the pumps comprises an elastic bladder between the plunger and the content, and where at least one of the pumps does not comprise a bladder.

18. The pumping system of claim 14, where the driving mechanism comprises a variable-speed actuator or a variable-speed motor, where the pumping system, during the discharge stroke, displaces about three liters of content, where the discharge stroke comprises a duration of about an hour, and where the suction stroke comprises a duration of from about one (1) to about three (3) minutes.

19. The pumping system of claim 14, further comprising:

a rigid coupling connecting the driving mechanism to the plungers, the rigid coupling imparting motion of the driving mechanism to the plungers;

where the first duration is on an order of one or more hours and the second duration is on an order of one or more minutes, where at least three of the pumps comprise an elastic bladder between the plunger and the content, and where at least one of the pumps does not comprise a bladder.

* * * * *